US011565782B1

(12) United States Patent
Iliev et al.

(10) Patent No.: US 11,565,782 B1
(45) Date of Patent: Jan. 31, 2023

(54) OUTBOARD ENGINE BALLISTIC PROTECTION

(71) Applicant: ShotStop Ballistics LLC, Stow, OH (US)

(72) Inventors: Vall Iliev, Stow, OH (US); Martin Iliev, Stow, OH (US)

(73) Assignee: SHOTSTOP BALLISTICS LLC, Stow, OH (US)

( * ) Notice: Subject to any disclaimer, the term of this patent is extended or adjusted under 35 U.S.C. 154(b) by 358 days.

(21) Appl. No.: 16/888,907

(22) Filed: Jun. 1, 2020

Related U.S. Application Data

(60) Provisional application No. 62/865,234, filed on Jun. 23, 2019.

(51) Int. Cl.

| | |
|---|---|
| ***B63H 20/32*** | (2006.01) |
| ***B63G 9/00*** | (2006.01) |
| ***F41H 5/04*** | (2006.01) |
| ***F41H 5/013*** | (2006.01) |

(52) U.S. Cl.
CPC ..... *B63G 9/00* (2013.01); *B63H 20/32* (2013.01); *F41H 5/013* (2013.01); *F41H 5/0492* (2013.01)

(58) Field of Classification Search
CPC ..... B63G 9/00; B63G 2009/005; B63G 9/02; B63G 9/04; B63G 9/06; B63G 13/00; B63B 3/10; F41H 5/013; F41H 5/0492
See application file for complete search history.

(56) References Cited

U.S. PATENT DOCUMENTS

| | | | | |
|---|---|---|---|---|
| 1,317,323 | A * | 9/1919 | Schmidt | F41H 5/013 89/40.03 |
| 2,371,340 | A * | 3/1945 | Masloff | B63G 9/00 114/78 |
| 2,475,135 | A * | 7/1949 | Haven | B63H 20/36 294/142 |
| 6,323,145 | B1 * | 11/2001 | Popper | F41H 5/0485 442/389 |
| 9,592,896 | B1 * | 3/2017 | Scriven | B63G 13/00 |
| 10,710,692 | B1 * | 7/2020 | Wittich | B63H 20/36 |
| 2003/0217638 | A1 * | 11/2003 | Fleming | B63B 7/082 89/36.12 |
| 2013/0081534 | A1 * | 4/2013 | Greenwood | F41H 7/046 89/937 |

* cited by examiner

*Primary Examiner* — Andrew Polay
(74) *Attorney, Agent, or Firm* — Gugliotta & Gugliotta LPA

(57) ABSTRACT

An outboard engine ballistic protection system is provided that can be adapted for use with existing small water craft outboard motors. A mounting band circumscribes and is affixed to the power head cowling. The mounting band may be formed of a pair of symmetrically affixed band straps that may be impinged about the cowling and secured fore and aft via a fastening mechanism. Laterally extended struts are provided offset from the port, starboard and aft sections of the power head. A panel support is perpendicularly affixed at an outer terminus of each strut. Mounted to the panel supports about an outer perimeter are a port protection panel, a starboard protection panel, and an aft protection panel. Each protection panel forms ballistic barrier system providing low weight, high energy absorbing structures and materials for ballistic protection against projectiles from munitions and/or shrapnel.

20 Claims, 4 Drawing Sheets

OUTBOARD ENGINE BALLISTIC PROTECTION

RELATED APPLICATIONS

The present invention claims benefit of U.S. Provisional Application 62/865,234, filed on 23 Jun. 2019 and incorporated by reference as if fully rewritten herein.

BACKGROUND OF THE INVENTION

1. Field of the Invention

This invention relates generally to penetration shields, and, more particularly, to penetration resistant structures used to protect marine outboard engines from incoming projectiles.

2. Description of the Related Art

Many vehicles and structures intended for military conflict arenas have ballistic shielding for protection against incoming projectiles. However, with vehicles such as light aircraft and small water craft, ballistic protection has generally been limited to attenuating the otherwise catastrophic consequences that can result to critical components by flying engine fragments produced by an explosive engine failure.

For small water craft, outboard motors are a common propulsion system that generally consists of a self-contained unit that includes engine, gearbox and propeller or jet drive, designed as an integrated unit and affixed to the outside of the transom. Outboard motors are the most common method of propelling small water craft. In addition to propulsion, outboards provide steering control in that they are designed to pivot over their mountings and thus control the direction of thrust. The skeg also acts as a rudder when the engine is not running. Unlike inboard motors, outboard motors can be easily removed for storage or repairs.

An additional feature of outboards is that the motor can be tilted up to an elevated position either electronically or manually in order to eliminate the chances of hitting bottom. This helps when traveling through shallow waters or where there may be debris that could potentially damage the motor as well as the propeller.

Given the various operational features and complex form factors and articulations, providing ballistic resistant shielding for use with outboard motors has, to date, been unavailable. However, given a modern trend toward asymmetric warfare the ability to provide ballistic protections, including protection from long arm fire, for small water craft is needed.

Consequently, a desire exists to provide ballistic protection at minimum weight and cost and installation and functional simplicity to reduce the risk of incoming ballistic damages to an outboard engine.

SUMMARY OF THE INVENTION

Objects of the present invention include to provide a system for and a method of ballistic protection for an outboard engine.

It is a feature of the present invention to provide ballistic resistant assemblies that may be supported by an engine housing mounting band in a manner that further does not interfere with the operational aspects of the outboard motor.

Briefly described according to the preferred embodiment of the present invention, an outboard engine ballistic protection system is provided that can be adapted for use with existing small water craft outboard motors. A mounting band circumscribes and is affixed to the power head cowling. The mounting band may be formed of a pair of symmetrically affixed band straps that may be impinged about the cowling and secured fore and aft via a fastening mechanism. Laterally extended struts are provided offset from the port, starboard and aft sections of the power head. A panel support is perpendicularly affixed at an outer terminus of each strut. Mounted to the panel supports about an outer perimeter are a port protection panel, a starboard protection panel, and an aft protection panel. Each protection panel forms ballistic barrier system providing low weight, high energy absorbing structures and materials for ballistic protection against projectiles from munitions and/or shrapnel. Each protection panel may form any level of NIJ protection, including but not limited to NIJ Level III or NIJ Level IIIA.

The inclusion of the present invention may provide ballistic protection for the operational elements of the outboard motor without hindering the otherwise conventional operation of the motor.

Further, the protection panels are fixedly or substantially fixed with respect to the power head during normal operation.

Further still, such ballistic barriers are more optimal in terms of weight, cost, and ease of installation as well as for removal for water craft maintenance, repair or inspections.

Further objects, features, elements and advantages of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
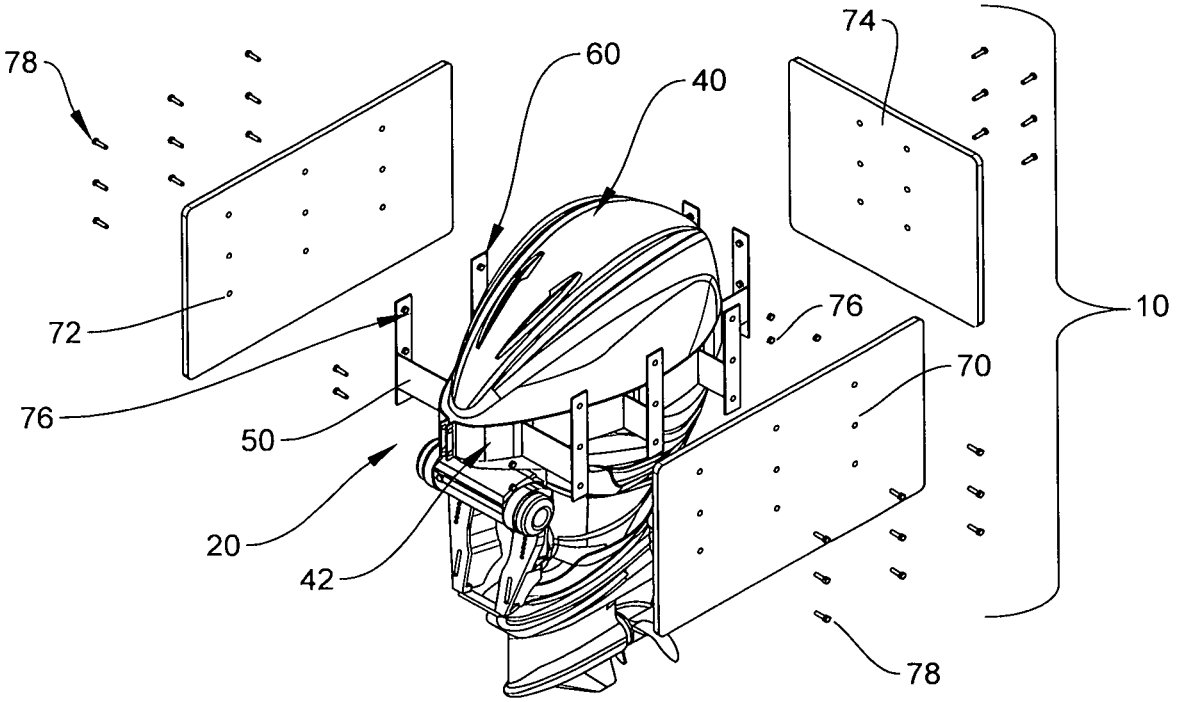
FIG. 1 is a partially exploded perspective view of an outboard engine ballistic protection system according to an exemplary preferred embodiment of the present invention.
Figure 2:
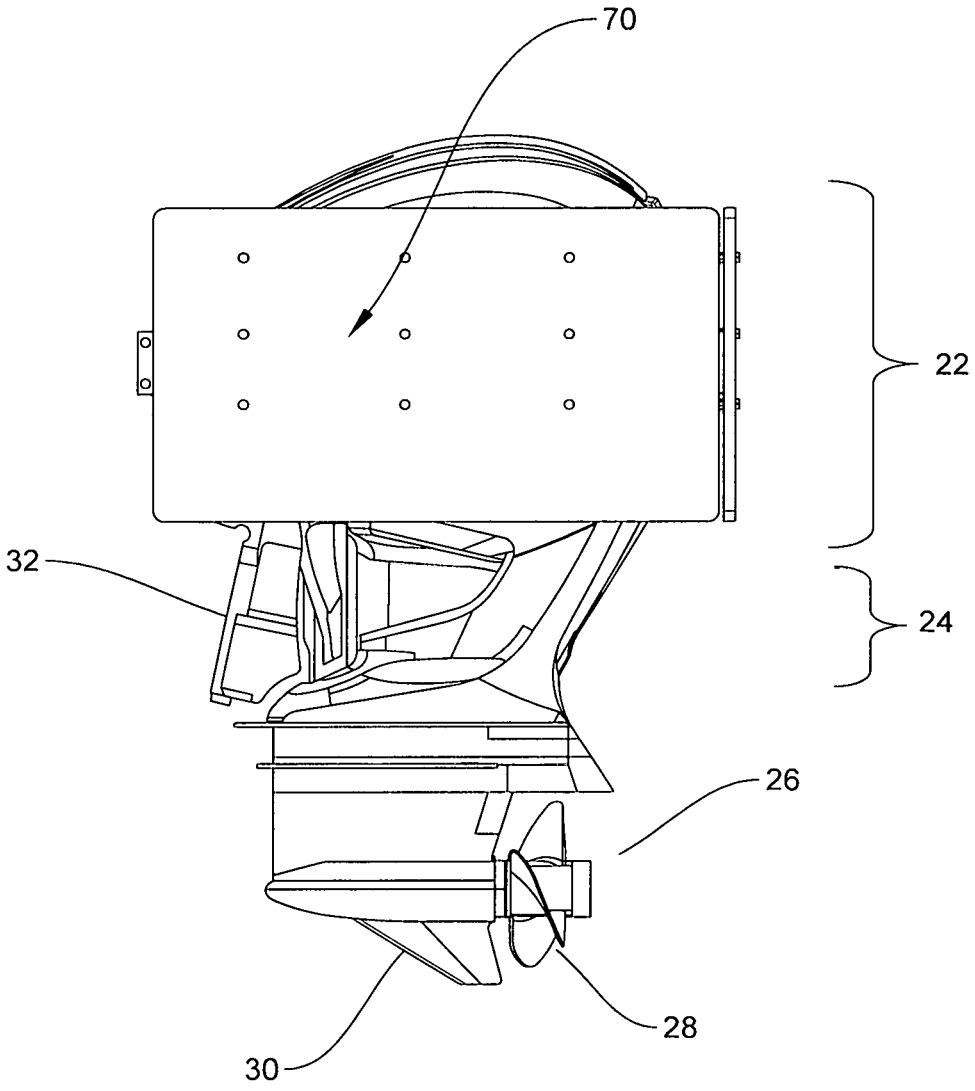
FIG. 2 is a port side elevational view thereof.
Figure 3:
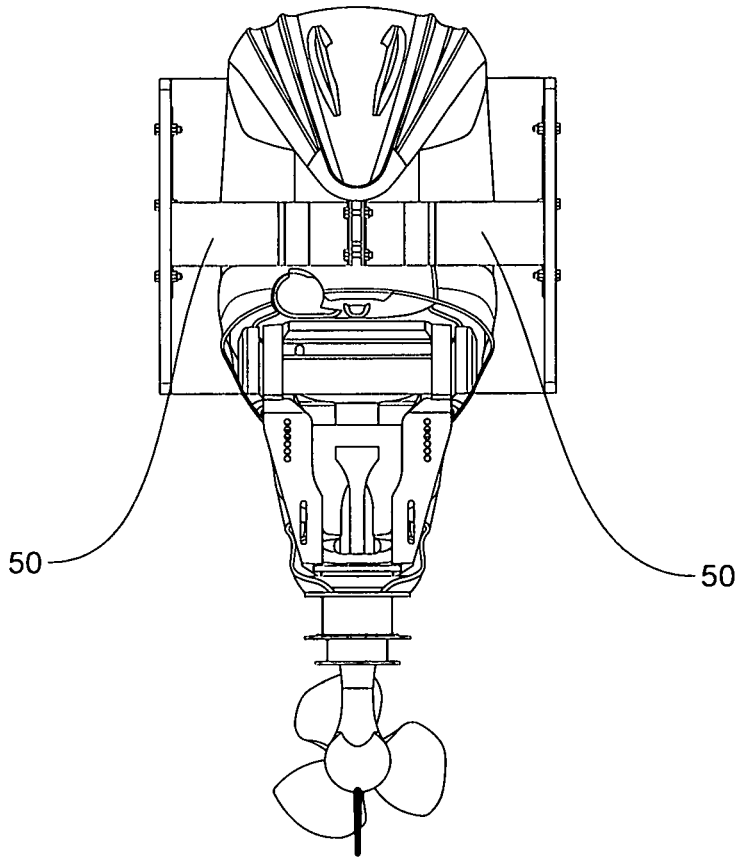
FIG. 3 is a front elevational view thereof.
Figure 4:
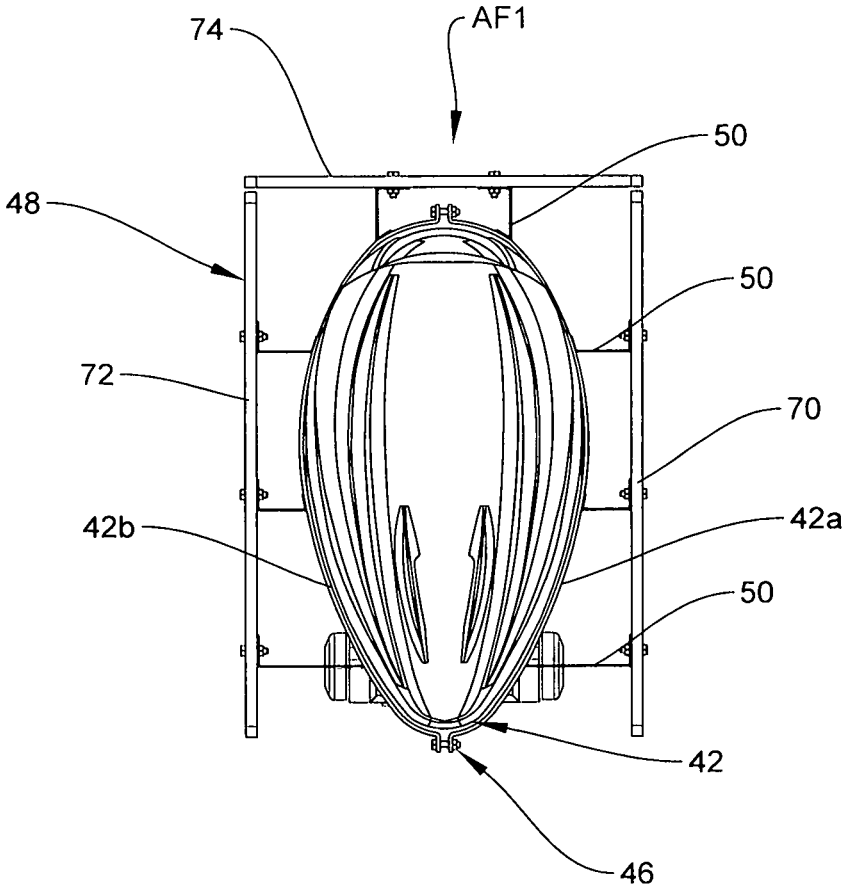
FIG. 4 is a top plan view thereof.

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112(f).

The best mode for carrying out the invention is presented in terms of its preferred embodiment, herein depicted within the Figures.

1. Detailed Description of the Figures

Before explaining the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation.

Referring now to the drawings, wherein like reference numerals indicate the same parts throughout the several views, an outboard engine ballistic protection system, generally noted as 10, is shown according to the preferred embodiment of the present invention. The system 10 may be provided in conjunction with an outboard motor, or can be adapted for use with existing small water craft outboard motors.

The outboard motor 20 may comprise a form factor including a power head 22, a midsection 24, and a gearbox or lower unit 26. The gearbox 26 drives a propeller 28 or, alternately, a jet drive (not shown). A skeg 30 may extend from the bottom of the lower unit 26. A mounting bracket 32 may be affixed to the midsection 24 to the stern of a water craft (not shown).

The power head 22 may include a cowling 40 that contains the motor and forms a general containment structure. A mounting band assembly 42 circumscribes and is affixed to the power head cowling 40. The mounting band assembly 42 may be formed of a port mounting band 42*a* and a starboard mounting band 42*b*. The two mounting bands 42*a*/42*b* may comprise a pair of symmetrically affixed band straps that may be impinged about the cowling 40 and secured fore and aft via a fastening mechanism 44, shown herein exemplarily as a mounting band nuts 46 and mounting band bolts 48.

Each mounting band 42*a*, 42 may include a plurality of laterally extended struts 50. As shown herein a single aft directed strut and a plurality of linearly aligned outwardly offset struts are provided. The system of struts 50 provide an offset mounting capability from the port, starboard and aft sections of the power head 22.

Each strut 50 may support a panel support 60. Each panel support 60 may be perpendicularly affixed at an outer terminus of its respective strut 50. The panel supports 60 may be perpendicularly planar and linearly extended. Mounted to the panel supports 60 about an outer perimeter are a port protection panel 70, a starboard protection panel 72, and an aft protection panel 74. Each protection panel 70/72/74 may be affixed rigidly to the panel supports 60, shown herein via the use of panel nut 76 and panel bolt 78 fasteners.

Each protection panel 70, 72 or 74 may form a ballistic barrier system providing low weight, high energy absorbing structures for ballistic protection against projectiles from munitions and/or shrapnel. Each protection panel 70/72/74 may form any level of NIJ protection, including but not limited to NIJ Level III or NIJ Level IIIA.

The ballistic resistant panels 70, 72 or 74 may be formed of a ballistic resistant material that is capable of providing protection at least including level IIIA, National Institute of Justice, N12 standard 0108.01. In an exemplary aspect of the present invention, an otherwise amorphous plastic such as high density polyethylene ("HDPE") having an unaligned, non-crystalline molecular structure is modified such as to result in a planar sheet material having a targeted molecular alignment. By mechanically modifying the HDPE, the alignment of the fibers creates an anisotropic material that can be further utilized as molecularly oriented thin planar sheets that are also structurally rigid as well as buoyant in the event it contacts the water. The ballistic resistant panels may be formed of such materials may be of an overall planar area silhouetting the key functional elements of the outboard motor 10. It has been found that by modifying the thickness of the panels a sufficient and desired level of ballistic resistance may be achieved.

Each ballistic panel 70, 72, 74 may further include variations of textured planar material or flat planar material formed of strand or ribbon oriented strips polyethylene as more fully shown, taught and described in U.S. Pat. No. 9,180,623, incorporated by reference as if rewritten herein in its entirety. As shown generally in the related art, the use of PE or HDPE in the production of composite materials capable of being used to create anti-ballistic devices is taught through the use of blending with carbon nanotube or other additives, orienting the materials into aligned strips to create oriented plies of materials, and then layering numerous plies at a bias to one another while building a desired thickness of material. Such processing transforms relatively inexpensive, common plastic materials into composite panels that both have anti-ballistic properties, as well as can be further formed into three dimensional shaped products such as helmets, shields or custom shapes as needed by the end user.

Similar to any plastics, PE/HDPE is an amorphous plastic having a nebulous, fluid-like non-crystalline molecular structure. Since PE is an amorphous material, it does not have a yield failure point like crystalline materials. As such, PE/HDPE is an elastic material that remains elastic throughout its elongation all the way up to the break point. Since it is an amorphous material, it is not subject to environmental stress cracking nor stress cracks when exposed to multi-axial stresses. However, PE, HDPE or equivalent materials themselves are generally hard and rigid and lacks good elongation properties necessary for use as ballistic materials. In order to improve this characteristic and make the resultant product soft and pliable, mechanical modification of the orientation of the non-crystalline molecular structure is provided.

Finally, as should be understood in conjunction with the present and related prior teachings, the (composite) material herein formed herein, after laminated, may be further cured using heat to form a sheet or a three-dimensional shape for use in final product designs such as in helmets, shields, armor vest carrier inserts, or custom shapes as needed by the end user.

2. Operation of the Preferred Embodiment

In operation, the present invention may by used to provide ballistic protection for an outboard motor at minimum weight and cost and installation and functional simplicity to reduce the risk of incoming ballistic damages to an outboard engine. The system 10 further installs easily without interference to the operation of the outboard motor. The mounting band assembly 42 is mounted about the cowling 40, and the panels 70, 72 and 74 may be affixed thereto. In order to access the outboard motor for maintenance or repairs, the system may be disassembled by performing the reverse steps.

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, and to thereby enable others skilled in the art to best utilize the invention and its various embodiments with various modifications as is suited to the particular use contemplated. It is intended that a scope of the invention is defined broadly by the Drawings and Specification appended hereto and to their equivalents. Therefore, the scope of the invention is in no way to be limited only by any adverse inference under the rulings of *Warner-Jenkinson Company*, v. *Hilton Davis Chemical,* 520 US 17 (1997) or *Festo Corp.* v. *Shoketsu Kinzoku Kogyo Kabushiki Co.,* 535 U.S. 722 (2002), or other similar caselaw or subsequent precedent should not be made if any future claims are added or amended subsequent to this Patent Application.

What is claimed is:

1. A system for provide outboard engine ballistic protection for use with existing small water craft outboard motors and comprising:

a mounting band circumscribing and affixing to a power head cowling;

a plurality of laterally extended struts affixed offset from the mounting band and positioned to a port, a starboard and an aft section of the power head; and a system of panel supports affixed at an outer terminus of each strut, said system of panel supports circumscribing about at least a portion of an outer perimeter of the power head.

2. The system for provide outboard engine ballistic protection of claim 1, wherein said mounting band comprises pair of symmetrically affixed band straps impinged about the cowling and secured fore and aft via a fastening mechanism.

3. The system for provide outboard engine ballistic protection of claim 1, wherein the system of panel supports is manufactured of a fiberless composite ballistic shielding comprising:

a plurality of individual layers, each said layer comprising a plurality of film strips oriented side by side and affixed with a thermosetting adhesive, wherein each said plurality of film strips are less than approximately 0.010" in width;

adjacent said individual layers at a bias angle and to a pre-determined number of layers or a desired thickness;

a thermosetting adhesive between said adjacent said individual layers; and said oriented plurality of layers pressed and cured to form a panel.

4. The system for provide outboard engine ballistic protection of claim 3, wherein the film forming said film strips has a modulus of elasticity less than 25%.

5. The system for provide outboard engine ballistic protection of claim 4, wherein said film further includes a functional additive material is selected from the group consisting of: flame-retardants; and carbon nanotubes suspended in solution.

6. The system for provide outboard engine ballistic protection of claim 1, wherein said system of panel supports comprises a series of individual protection panels selected from a group consisting of: a port protection panel; a starboard protection panel; and an aft protection panel.

7. The system for provide outboard engine ballistic protection of claim 1, wherein each panel supports forms a ballistic barrier having an energy absorbing structure for ballistic protection against projectiles from munitions or shrapnel.

8. The system for provide outboard engine ballistic protection of claim 2, wherein each panel supports forms a ballistic barrier having an energy absorbing structure for ballistic protection against projectiles from munitions or shrapnel.

9. The system for provide outboard engine ballistic protection of claim 3, wherein each panel supports forms a ballistic barrier having an energy absorbing structure for ballistic protection against projectiles from munitions or shrapnel.

10. The system for provide outboard engine ballistic protection of claim 4, wherein each panel supports forms a ballistic barrier having an energy absorbing structure for ballistic protection against projectiles from munitions or shrapnel.

11. The system for provide outboard engine ballistic protection of claim 5, wherein said each of said series of protection panels forms a ballistic barrier having an energy absorbing structure for ballistic protection against projectiles from munitions or shrapnel.

12. The system for provide outboard engine ballistic protection of claim 7, wherein said ballistic barrier forms a level of NIJ protection where NIJ protection is defined as capable of resisting penetration from projectile having an energy at least the equivalent of a projectile energy of a 9 mm full metal jacket round nose bullet with a specified mass of 8.0 g (124 gr) and a velocity of 355 m/s±9.1 m/s (1165 ft/s±30 ft/s) or a .40 Smith & Wesson Full Metal Jacket bullet with a specified mass of 11.7 g (180 gr) and a velocity of 325 m/s±9.1 m/s (1065 ft/s±30 ft/s).

13. The system for provide outboard engine ballistic protection of claim 8, wherein said ballistic barrier forms a level of NIJ protection where NIJ protection is defined as capable of resisting penetration from projectile having an energy at least the equivalent of a projectile energy of a 9 mm full metal jacket round nose bullet with a specified mass of 8.0 g (124 gr) and a velocity of 355 m/s±9.1 m/s (1165 ft/s±30 ft/s) or a .40 Smith & Wesson Full Metal Jacket bullet with a specified mass of 11.7 g (180 gr) and a velocity of 325 m/s±9.1 m/s (1065 ft/s±30 ft/s).

14. The system for provide outboard engine ballistic protection of claim 9, wherein said ballistic barrier forms a level of NIJ protection where NIJ protection is defined as capable of resisting penetration from projectile having an energy at least the equivalent of a projectile energy of a 9 mm full metal jacket round nose bullet with a specified mass of 8.0 g (124 gr) and a velocity of 355 m/s±9.1 m/s (1165 ft/s±30 ft/s) or a .40 Smith & Wesson Full Metal Jacket bullet with a specified mass of 11.7 g (180 gr) and a velocity of 325 m/s±9.1 m/s (1065 ft/s±30 ft/s).

15. The system for provide outboard engine ballistic protection of claim 10, wherein said ballistic barrier forms a level of NIJ protection where NIJ protection is defined as capable of resisting penetration from projectile having an energy at least the equivalent of a projectile energy of a 9 mm full metal jacket round nose bullet with a specified mass of 8.0 g (124 gr) and a velocity of 355 m/s±9.1 m/s (1165 ft/s±30 ft/s) or a .40 Smith & Wesson Full Metal Jacket bullet with a specified mass of 11.7 g (180 gr) and a velocity of 325 m/s±9.1 m/s (1065 ft/s±30 ft/s).

16. The system for provide outboard engine ballistic protection of claim 11, wherein said ballistic barrier forms a level of NIJ protection where NIJ protection is defined as capable of resisting penetration from projectile having an energy at least the equivalent of a projectile energy of a 9 mm full metal jacket round nose bullet with a specified mass of 8.0 g (124 gr) and a velocity of 355 m/s±9.1 m/s (1165 ft/s±30 ft/s) or a .40 Smith & Wesson Full Metal Jacket bullet with a specified mass of 11.7 g (180 gr) and a velocity of 325 m/s±9.1 m/s (1065 ft/s±30 ft/s).

17. A method for providing outboard engine ballistic protection comprising:

obtaining a water craft having at least one outboard motor;

affixing a mounting band circumscribing to a power head cowling of the at least one outboard motor;

affixing a plurality of laterally extended struts in an offset manner from the mounting band and positioned to a port, a starboard and an aft section of the power head; and affixing a system of panel supports at an outer terminus of each strut, said system of panel supports circumscribing about at least a portion of an outer perimeter of the power head.

18. The method of claim 17, wherein said film further includes a functional additive material is selected from the group consisting of: flame-retardants; and carbon nanotubes suspended in solution.

19. The method of claim 17, wherein the system of panel supports is manufactured of a fiberless composite ballistic shielding comprising:

a plurality of individual layers, each said layer comprising a plurality of film strips oriented side by side and affixed with a thermosetting adhesive, wherein each said plurality of film strips are less than approximately 0.010" in width;

adjacent said individual layers at a bias angle and to a pre-determined number of layers or a desired thickness;

a thermosetting adhesive between said adjacent said individual layers; and said oriented plurality of layers pressed and cured to form a panel.

20. The method of claim 19, wherein the film forming said film strips has a modulus of elasticity less than 25%.

* * * * *